United States Patent [19]

Hammond

[11] 4,347,689

[45] Sep. 7, 1982

[54] METHOD FOR BURNISHING

[75] Inventor: Craig B. Hammond, San Jose, Calif.

[73] Assignee: Verbatim Corporation, Sunnyvale, Calif.

[21] Appl. No.: 198,714

[22] Filed: Oct. 20, 1980

[51] Int. Cl.[3] ..... B24B 1/00

[52] U.S. Cl. ..... 51/281 SF; 51/145 R

[58] Field of Search ..... 51/281 SF, 145 R, 147, 51/142

[56] References Cited

U.S. PATENT DOCUMENTS

| | | | |
|---|---|---|---|
| 1,974,806 | 9/1934 | Curtis | 51/142 |
| 2,449,387 | 9/1948 | Johnson | 51/145 R |
| 2,573,220 | 10/1951 | Riedesel | 51/142 |
| 4,179,852 | 12/1979 | Barnett | 51/281 SF |

*Primary Examiner*—Harold D. Whitehead

*Attorney, Agent, or Firm*—Thomas E. Schatzel

[57] ABSTRACT

A method and apparatus for burnishing the coated recording surface of magnetic disks. The method consists in contacting the coated surface of a rotary disk with a longitudinally stationary length of an abrasive burnishing tape while oscillating that tape laterally back and forth across the surface. The length of the tape has a first segment which is urged into contact with the coated surface and a much longer second segment which is urged into contact only by its own weight. Prior to burnishing each surface, the tape is advanced longitudinally so that a section of the tape serves as the first segment for only a single coated surface and so that a section of the tape to serve as the first segment has already served as the second segment in burnishing prior coated surfaces. The apparatus employed to burnish the coated surface of disks has a rotating platen onto which a disk is placed and an arm around one terminal end of which the tape passes. The apparatus also has apparatus for lowering the arm, oscillating it, laterally raising it and advancing the tape. The operation of these mechanical elements of the apparatus are controlled and synchronized by a system of electronic control modules and transducers.

12 Claims, 4 Drawing Figures

METHOD FOR BURNISHING

BACKGROUND OF THE INVENTION

1. Field of the Invention

The present invention relates generally to surface polishing and more particularly to a method and apparatus for burnishing surface disks.

2. Description of the Prior Art

Widely used in the computer industry is a data storage medium comprised of a circular disk of flexible material up to eight inches in diameter which is coated with magnetic particles and enclosed within an envelope. These disks are known in the trade as "floppy disks." The magnetic coating is very thin and comprises minute magnetic oxide particles dispersed in a resin binder. When this coating is initially applied to the flexible material, the surface of the coating contains irregularities such as protruding particles of iron oxide or lumps of binder material. These irregularities must be removed from the coated surface before that surface can be used to record and reproduce data. Failure to remove these irregularities causes the recording-reproducing transducer to either raise slightly as it passes over such particles, reducing the quality of the recording, or to crash into the particle, ultimately destroying the oxide-coated surface.

The standard technique widely used within the industry to remove these irregularities is to polish or burnish the oxide-coated surface. U.S. Pat. No. 3,943,666 issued to Dion et al. relates to disk burnishing and depicts the placing of the flexible material on a resilient surface and contacting the oxide-coated surface with a moving ceramic tool. Some deficiencies in this method have been previously pointed out as in U.S. Pat. No. 4,179,852 issued to Barnett which states that:

"The cost of the floppy disk is further increased because ceramic abrasive elements are expensive, and their useful life is quite short because the removed magnetic oxide material tends to 'build up' in the ceramic abrasive material, and also wears-out the ceramic material. Further, 'wipers' may in some uses be required to remove debris consisting of abraded magnetic oxide particles from the recording surface to prevent such particles from contributing to scratching of the recording layer during the continuing passing of the recording surface under the abrasive member. Such wipers add complexity and expense to the burnishing process and the burnishing machinery."

Furthermore, while the method and apparatus of the Dion reference may successfully burnish coatings whose thickness lies between 110 and 140 microinches, its use for thinner coatings, particularly those ranging between 30 and 50 microinches appears to be somewhat limited in that it tends to destroy such coatings. The inability of the Dion apparatus to burnish these thin coatings may be due to the fact that it is a slow process which generates a great deal of heat.

The Barnett patent teaches a method of burnishing floppy disks by contacting the oxide-coated surface of the recording disk with the surface of a second burnishing disk. In this method both disks rotate in the same direction in parallel planes and are positioned so a portion of the burnishing disk, not including its center, overlaps a portion of the floppy disk. The speed of rotation of the floppy disk and the burnishing disk are controlled such that the relative velocities between the burnishing disk and the floppy disk are uniform at points of contact between the two disks.

SUMMARY OF THE PRESENT INVENTION

An object of the present invention is to provide an improved method for burnishing thinner oxide-coated recording surfaces.

Another object of the present invention is to minimize the scratching and tearing of the oxide coating while removing irregularities.

Another object of the present invention is to provide a faster method for burnishing oxide-coated surfaces.

Another object of the present invention is to provide a method for burnishing oxide surfaces which generates less heat.

Briefly, a preferred embodiment of the present invention includes a drive for rotating the floppy disk to be burnished about the disk's center while contacting the oxide-coated surface of the disk with a length of flexible tape coated with abrasive particles and simultaneously oscillating that tape laterally back and forth across the coated surface. The segment of abrasive tape contacts the oxide-coated surface along more than one-half the length of a chord of the disk. The contacting segment of abrasive tape comprises two longitudinal regions which extend across the full width of the tape. The first region of the abrasive tape contacted by a moving point on the oxide-coated surface is urged into contact with that surface. The second region, which constitutes almost the entire length of the segment of the tape in contact with the oxide-coated surface, merely lays loosely across the surface being burnished. Between burnishing successive disks, the abrasive tape is advanced so that the region which was urged into contact with the oxide-coated surface does not contact the oxide-coated surface of the subsequent disks. Further, the abrasive tape is advanced so as to ensure that the region to be urged into contact is part of the region lightly urged into contact while burnishing prior disks.

An advantage of the method and apparatus of the present invention is that thinner oxide-coated surfaces can be burnished.

Another advantage of the present invention is that scratching and tearing of the oxide-coated surface is minimized while irregularities are removed.

Another advantage of the present invention is that the time required to burnish a floppy disk is reduced.

Another advantage of the present invention is that the oxide-coated surface of the floppy disk remains cooler during burnishing.

Another advantage of the present invention is that the apparatus for burnishing is simpler.

Another advantage of the present invention is that the abrasive surface of the burnishing tape can be renewed and the tape can be used over again.

These and other objects and advantages of the present invention will no doubt become obvious to those of ordinary skill in the art after having read the following detailed description of the preferred embodiment as illustrated in the various drawing figures.

IN THE DRAWING

DETAILED DESCRIPTION OF THE PREFERRED EMBODIMENT

Figure 1:
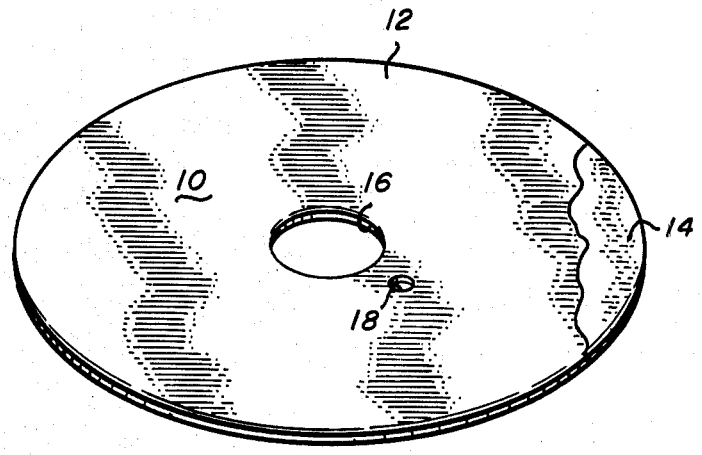
FIG. 1 is a perspective view of a floppy disk.

FIG. 1 shows a floppy disk referred to by the general reference number 10 having an oxide coated surface 12 applied as a thin coating to one or both sides of a sheet of flexible material 14. The floppy disk 10 has a circular aperture 16 located at its center and may have one or more small circular apertures 18 located either near the edge of the large circular aperture 16 or the circumference of the floppy disk 10. When installed in a device adapted for recording and reproducing information from the floppy disk 10 and in operation, a means for rotating the floppy disk 10 passes through the aperture 16 engaging the floppy disk 10 and rotating it about its axis of rotation.

Figure 2:
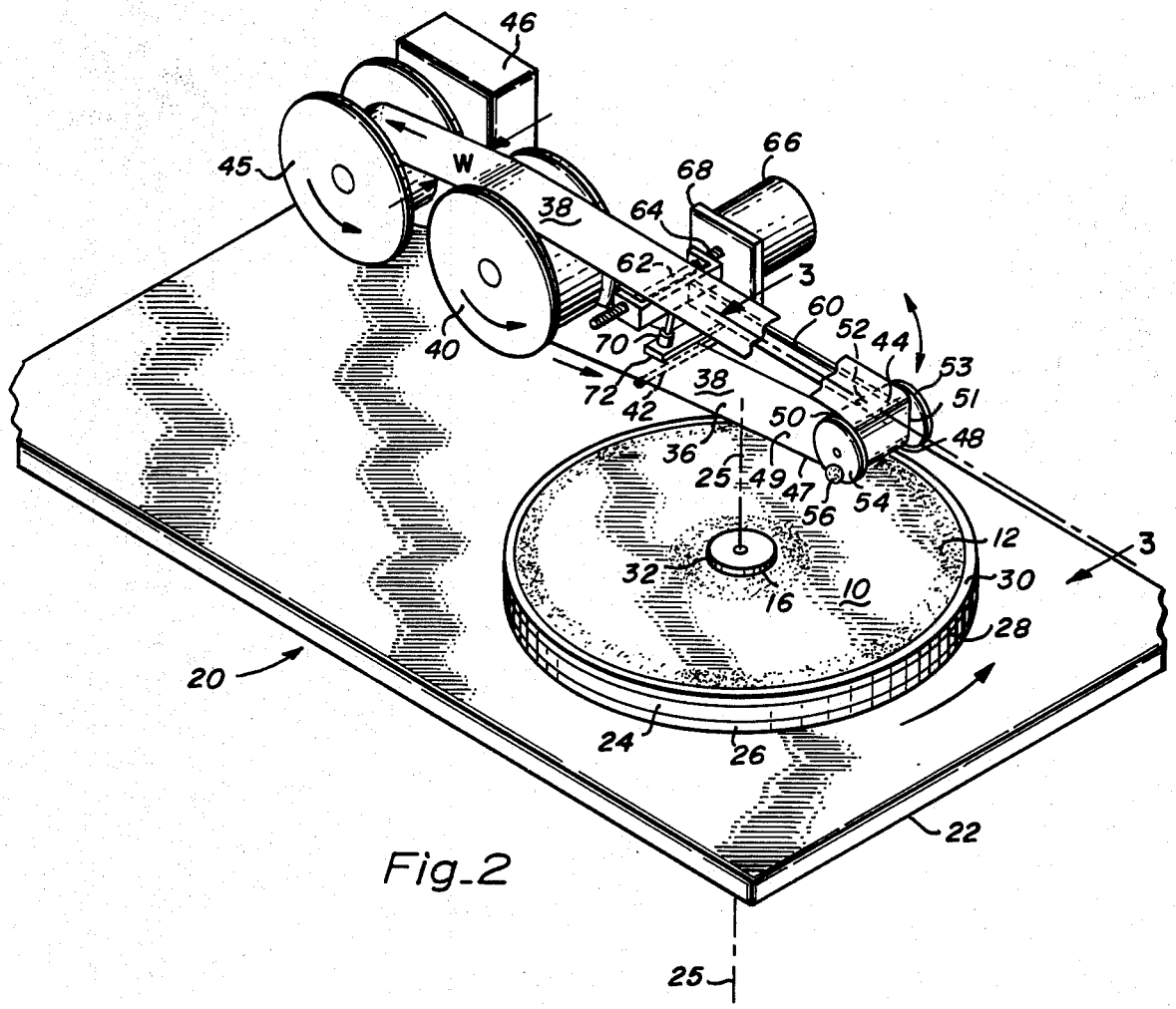
FIG. 2 is a perspective view of an apparatus in accordance with the present invention to burnish the floppy disk of FIG. 1.
Figure 3:
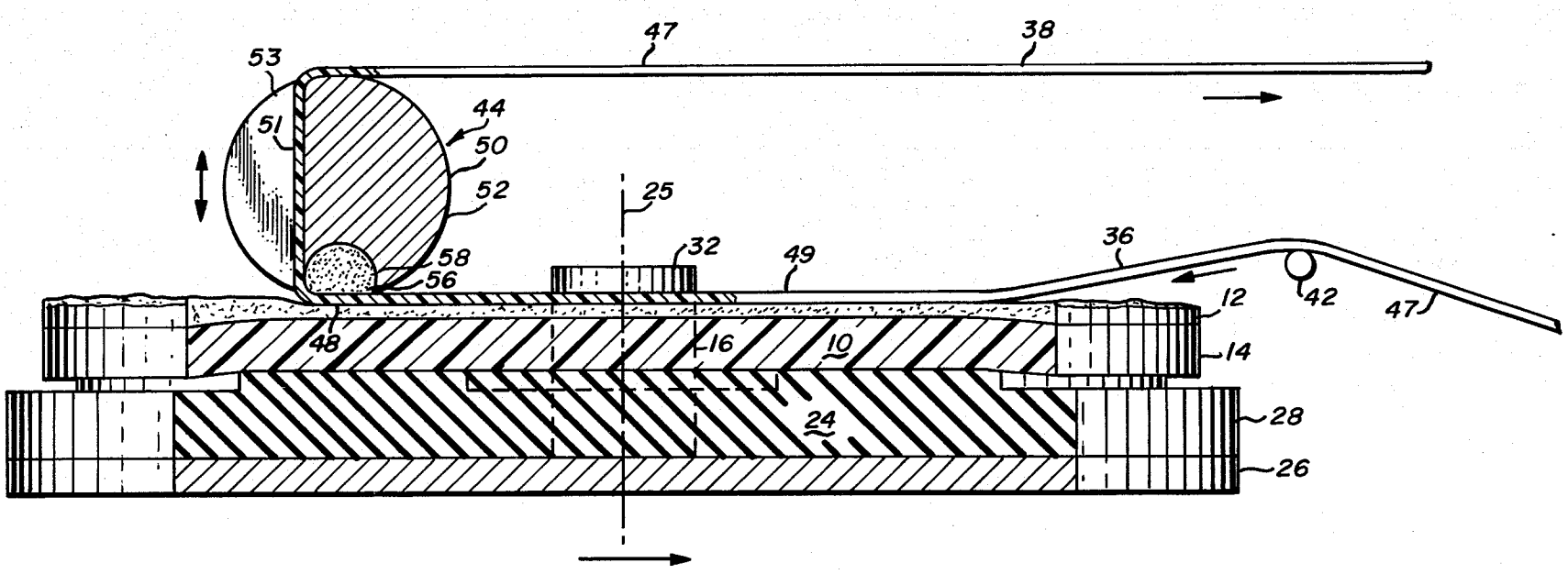
FIG. 3 is a cross-sectional view of the floppy disk and burnishing apparatus taken along the line 3—3 of FIG. 2.

FIG. 2 shows a burnishing apparatus referred to by the general reference number 20 and FIG. 3 is a cross-sectional view of a portion of the burnishing apparatus 20 taken along the line 3—3 of FIG. 1. The burnishing apparatus 20 includes a base plate 22 to which a disk-shaped platen 24 is attached so as to be rotatable about an axis 25. The platen 24, which receives the floppy disk 10, includes a substantially planar disk-shaped base 26 whose central cylindrical axis is coaxial with the axis 25. Bonded to the top surface of the disk-shaped base 26 is an annular layer of resilient material 28 of substantially uniform thickness. The annular layer of resilient material 28 has a top surface 30 having a hardness between fifty to eighty durometers which is formed to be substantially planar and perpendicular to the axis 25. The central cylindrical axis of the annular layer of resilient material 28 is also substantially coaxial with the axis 25. Passing through the central aperture of the annular layer of resilient material 28 and protruding above its top surface 30 is a spindle 32 shaped to fit snuggly but not lock the circular aperture 16 of the floppy disk 10. The central cylindrical axis of the spindle 32 is also substantially coaxial with the axis 25. The planar top surface 30 is capable of transmitting sufficient torque that the disk 10 placed upon it may be rotated without significant slippage between the disk 10 and the top surface 30 while the oxide-coated surface 12 is burnished.

The oxide-coated surface 12 of the disk 10 is contacted by a first portion 36 of a length of burnishing tape 38 having a width "W." The first portion 36 extends along a path from a feed reel 40, over a tape guide 42, above and across the top surface 30 and partially around the outside surface of a burnishing head 44. The path of the burnishing tape 38 continues from the burnishing head 44 to return over its first portion 36 and the feed reel 40 to a take-up reel 45. The take-up reel 45 is attached to a burnishing tape advancing means 46 so that the burnishing tape 38 may be advanced from the feed reel 40, around the burnishing head 44 to the take-up reel 45. The apparatus 20 is constructed such that the burnishing head 44 with the burnishing tape 38 wrapped partially around its outside surface may be lowered toward the top surface 30 of the layer of resilient material 28. Thus, the burnishing head 44 may apply a force urging an abrasive surface 47 of the burnishing tape 38 into intimate contact with the oxide-coated surface 12 of the floppy disk 10 located on top of the layer of resilient material 28.

The path of the first portion 36 has a substantially straight region displaced to one side of the spindle 32 in which it passes above and across the top surface 30 of the platen 24. The length of this region of the first portion 36 may be divided into two segments extending across the full width of the burnishing tape 38. A first segment 48, which is located in the region of the burnishing tape 38 about the burnishing head 44, is that segment of the first portion 36 which the burnishing head may urge into intimate contact with the oxide-coated surface 12 of the floppy disk 10. A second segment 49, sharing a common terminal end with the first segment 48, extends from that common terminal end along the length of the burnishing tape 38 toward the tape guide 42 until contact between the abrasive surface 47 and the oxide-coated surface 12 is broken. The length of the second segment 49, which the burnishing head 44 may not urge into contact with the oxide-coated surface 12 as measured along the edge of the first portion 36 closest to the spindle 32 exceeds one-half the length of chord on the oxide-coated surface 12 immediately adjacent to and parallel to that edge of the burnishing tape 38.

The feed reel 40 and the take-up reel 45 are mounted above the top surface of the base 22 so as to be rotatable about their respective axes which are substantially parallel to the top surface 30 of the layer of resilient material 28. These axes of rotation are roughly perpendicular to the length of the second segment 49 of the burnishing tape 38. Similarly, the tape guide 42, which comprises a cylindrical rod rigidly secured to the base 22, is also aligned so that it is substantially parallel to the top surface 30 and roughly perpendicular to the length of the second segment 49. The tape guide 42 is elevated slightly above the top surface 30 so as to cause the abrasive surface 47 of the burnishing tape 38 to cease contacting the oxide-coated surface 12 before reaching the edge of the floppy disk 10.

The burnishing head 44 around which burnishing tape 38 partially wraps includes a cylindrical body 50. The body 50 has an outside surface comprised of a planar surface 51 aligned parallel to the cylindrical axis of the body and edge-to-edge between the terminal ends of slightly more than one-half of a right circular cylindrical surface 52. The planar surface 51 is disposed such that it is essentially perpendicular to the top surface 30 when the burnishing head 44 is lowered into close proximity to the layer of resilient material 28. The planar face 51 is also aligned essentially perpendicular to the length of the first portion 36 of the burnishing tape 38. The length of the cylindrical body 50 is slightly greater than the width "W" of the burnishing tape 38.

The burnishing head 44 also includes two disk-shaped guiding flanges 53 and 54 which are respectively located about opposite terminal ends of the body 50. The cylindrical axis of the guiding flanges 53 and 54 are parallel to that of the body 50 and a circular planar face of each guiding flange 53 and 54 is in intimate contact with the terminal ends of the body 50. The diameter of the guiding flanges 53 and 54 is essentially equal to that of the right circular cylindrical surface 52 and the flanges 53 and 54 are disposed such that a portion of their circular edge surfaces are aligned with the surface 52. Consequently, a portion of the circular planar faces of each of the guiding flanges 53 and 54 in contact with the terminal ends of the body 50 projects outward beyond the terminal ends of the planar surface 51. These exposed surfaces of the guiding flanges 53 and 54 serve to constrain the burnishing tape 38 to move laterally with the burnishing head 44.

The burnishing head 44 further includes a soft, deformable cotton swab 56 in the shape of a right circular cylinder which is secured to the body 50 and the guiding flanges 53 and 54 by means of a substantially linear groove 58 formed in their circular surfaces. The groove 58 is formed in the cylindrical surface 52 on the bottom of the body 50 immediately adjacent to and parallel with the planar surface 51. The swab 56 is in the shape of a right circular cylinder extending end-to-end from the outside surface of the guiding flange 53 to the outside surface of the other guiding flange 54. The swab 56 projects from the groove 58 to such an extent that the surface of the cotton swab 56 most distant from the body 50 forms the region of the burnishing head 44 which may apply a force to the burnishing tape 38 urging it into contact with the floppy disk 10. No other surface of the burnishing head 44 may be closer to the oxide-coated surface 12 of the floppy disk 10 than the surface of the cotton swab 56 most distant from the body 50.

The body 50 of the burnishing head 44 is attached to one terminal end of a rod-shaped arm 60 whose other terminal end is attached to a yoke 62. The yoke 62 has two arms both of which are adapted to engage threads on a lead screw 64 extending outward colinearly from the rotary shaft of a bi-directional stepper motor 66. The stepper motor 66 is rigidly attached to the base plate 22 by means of a mounting plate 68.

Energizing the bi-directional stepper motor 66 so as to cause it to rotate in one direction or another causes the lead screw 64 to displace the threaded yoke 62 laterally in one direction or another along the length of the lead screw 64. Cyclic operating the stepper motor 66 so as to first turn in one direction and then to reverse its direction of rotation causes the yoke 62 to oscillate back and forth along the length of the lead screw 64. The arm 60 attached to the yoke 62 couples this lateral back and forth motion through the burnishing head 44 to the burnishing tape 38. The quality of the finish produced on the oxide-coated surface 12 by the burnishing apparatus 20 is influenced by the smoothness with which this mechanism oscillates the burnishing tape 38 laterally back and forth across the oxide-coated surface 12. Thus, in the preferred embodiment of this invention, the smooth lateral translation is obtained by rotating the shaft of the stepper motor 66 by two and one-half degrees for each step of the motor.

Beneath and supporting the yoke 62, near the point at which it attaches to the arm 60, is a pneumatic cylinder 70 which is secured to a bracket 72 extending out of the plate 68. Energizing the pneumatic cylinder 70 with a flow of compressed gases causes it to extend and press against the lower surface of the yoke 62. This causes the arm 62 with the burnishing head 44 attached thereto to rotate upward about the lead screw 64 thereby raising the burnishing head 44 with the burnishing tape 38 wrapped around it away from the oxide-coated surface 12 of the floppy disk 10. Due to the combined weights of the burnishing tape 38, the burnishing head 44, the arm 60 and the yoke 62, removal of gaseous pressure from the pneumatic cylinder 70 causes the burnishing head 44 to rotate downward until the abrasive surface 47 of the burnishing tape 38 contacts the oxide-coated surface 12.

The motions which the bidirectional motor 66 and the pneumatic cylinder 70 may inpart to the burnising head 44 may be combined. Thus, by removing gaseous pressure from the pneumatic cylinder 70 and energizing the stepping motor 66 so that it alternatively rotates first in one direction and then the other, the burnishing head 44 with the burnishing tape 38 wrapped around it may be lowered into close proximity to the oxide-coated surface 12 thereby urging the abrasive surface 47 of the burnishing tape 38 into intimate contact with the oxide-coated surface 12 while simultaneously oscillating the abrasive surface 47 laterally back and forth across the oxide-coated surface 12. The path along which the burnishing tape 38 oscillates is essentially parallel to the oxide-coated surface 12 and has little or no travel in the direction parallel to the length of the burnishing tape 38.

Figure 4:
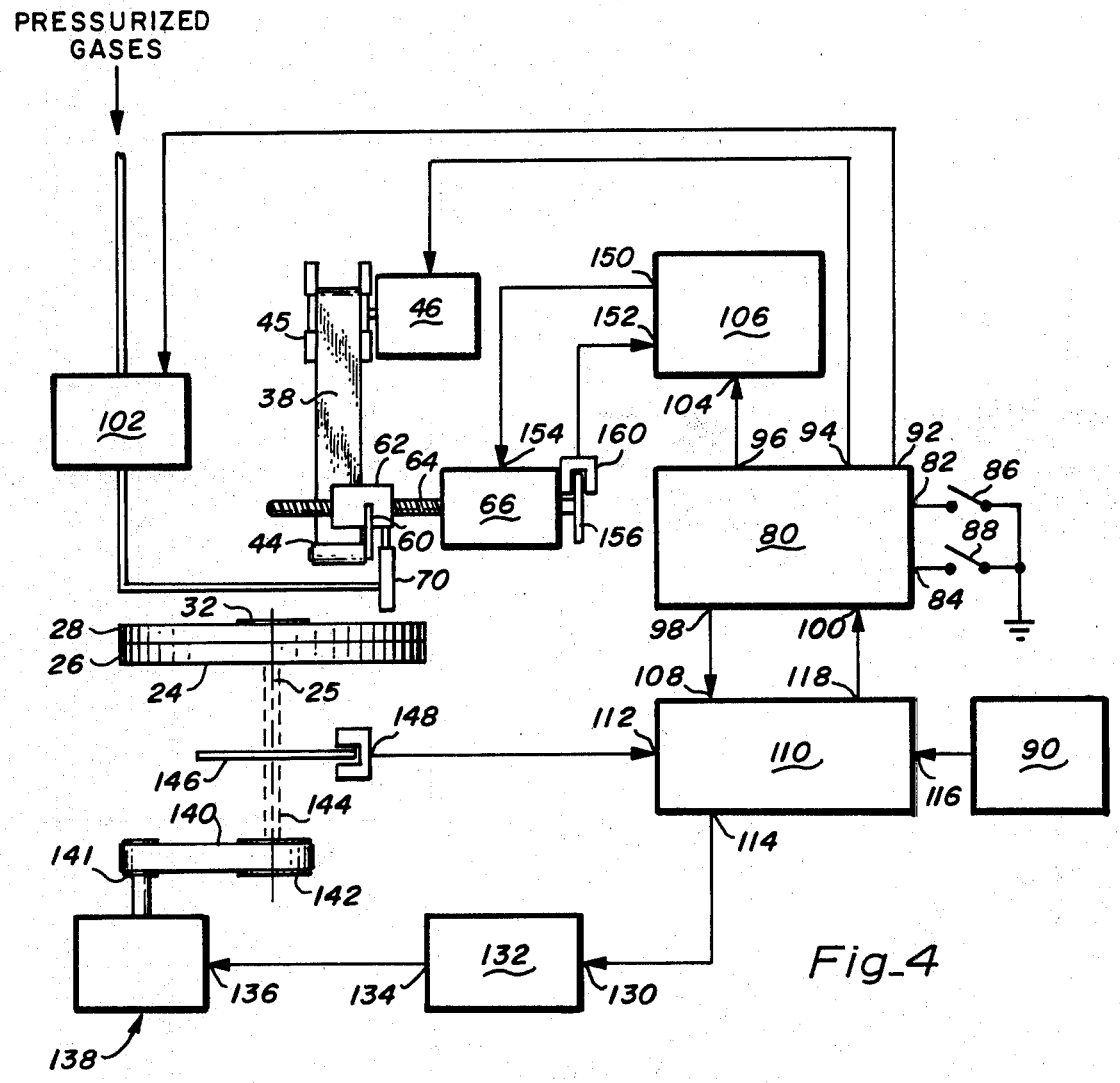
FIG. 4 is a block diagram of the electronic circuit which control the operation of the burnishing apparatus of FIG. 2.

The operation of the burnishing apparatus 20 is controlled by a system of electronic modules shown in the block diagram of FIG. 4. FIG. 4 also shows the transducers by which these electronic circuits both sense the state of the burnishing apparatus 20 and effect its operation. A control electronics module 80 has a start signal input terminal 82 and a stop signal input terminal 84. Electrically connected to the start signal input point 82 is a start switch 86 and similarly connected to the stop signal input point 84 is a stop switch 88. Both the start switch 86 and the stop switch 88 may be activated by an operator to control operation of the burnishing apparatus 20. A third means by which the operator may control operation of the burnishing apparatus 20 is provided by a thumb wheel switch 90 which permits setting the number of revolutions of the platen 24 for which the oxide-coated surface 12 of the floppy disk 10 is burnished.

The control electronics 80 also has a pneumatic control output 92, a tape advance output 94, an oscillation control output 96, a counter reset output 98 and an equals input 100. The pneumatic control output 92 is electrically connected to a compressed air valve 102. The tape advance output 94 is electrically connected to the burnishing tape advancing means 46. The oscillation control output 96 is electrically connected to a start/-stop control input 104 of a stepper motor control 106. The counter reset output 98 is electrically connected to a counter reset input 108 of a counter/comparator 110.

In addition to the counter reset input 108, the counter/comparator 110 has a pulse input 112, a platen rotation control output 114, a count set input 116 and an equals output 118. The equals output 118 of the counter/comparator 110 is connected to the equals input 100 of the control electronics 80. The count set input 116 is electrically connected to the thumb wheel switch 90 whose setting determines the number of revolutions of the platen 24 for which the oxide-coated surface 12 of the floppy disk 10 is burnished. The platen rotation control 114 is electrically connected to a platen start/-stop control input 130 of a platen motor control referred to by the general reference number 132.

The platen motor control 132 has a power output 134 electrically connected to a power input 136 of a platen motor 138. The platen motor control 132 supplies electrical current to the power input 136 of the platen motor 138 in response to control signals supplied to the platen start/stop control input 130 by the platen rotation control output 114 of the counter/comparator 110. The rotation of the energized platen motor 138 is coupled to the platen 24 by means of an endless belt 140 which passes around both a motor pulley 141 attached to the shaft of the motor 138 and a platen pulley 142 attached to a rod-shaped shaft 144. The shaft 144 is attached to and extends below the platen 24 and has its central cylindrical axis aligned with the axis of rotation of the platen 24. A tachometer wheel 146 is also rigidly secured to the shaft 144 and turns in synchronism with the platen 24. The tachometer sensing means 148, capable of generating a train of pulses of electrical current in response to rotation of the tachometer wheel 146, is positioned adjacent thereto. The tachometer sensing means 148 supplies the electrical current pulses which it generates to the counter/comparator 110 by means of an electrical connection to its pulse input 112.

The function of the counter/comparator 110 is to count pulses supplied to it by the tachometer sensing means 148 and to compare that count with a preset count supplied to it through the count set input 116. When the pulse counting portion of the counter/comparator 110 has been reset by means of a signal supplied to the counter reset input 108 from the counter reset output 98 of the control electronics 80, the counter/comparator 110 sends a control signal to the control input 130 of the platen motor control 132 causing it to energize the platen motor 138. Energizing the platen motor 138 causes the platen 24 to rotate and the tachometer sensing means 148 to send pulses of electrical current to the counter/comparator 110. So long as the count of these pulses remains less than the preset count, the counter/comparator 110 maintains this control signal thereby causing the platen motor 138 to remain energized. When the pulse count equals or exceeds the preset count supplied to the counter/comparator 110, the control signal is removed from the platen start/stop control input 130 causing the platen motor control 132 to de-energize the platen motor 138. In addition to sending a signal to the platen motor control 132, the counter/comparator 110 also supplies a signal to the equals input 100 of the control electronics 80 indicating that the pulse count has equaled or exceeded the present count.

The stepper motor control 106, whose start/stop control input 104 is connected to the control electronics 80, also has a step pulse output 150 and a direction input 152. The step pulse output 150 of the stepper motor control 106 is electrically connected to a step pulse input 154 of the bi-directional stepper motor 66. The stepper motor control 106 employs this connection to supply pulses of electrical current to the stepper motor 66 when activated by control signals supplied by the control electronics 80. The shaft of the stepper motor 66 turns in response to these electrical pulses thereby rotating both the lead screw 64 attached to one of its terminal ends and a shaft angle position encoder 156 attached to its other terminal end. A shaft angle position sensing means 160, capable of generating electrical current control signals in response to the angular position of the shaft angle position encoder 156, is positioned adjacent thereto. The shaft angle sensing means 160 supplies these control signals to the direction input 152 of the stepper motor control 106.

The function of the stepper motor control 106 is to provide electrical current pulses to the step pulse input 154 of the bi-directional stepper motor 66 in response to an electrical signal supplied to the start/stop control input 104 by the control electronics 80. The character of the pulses supplied to the step pulse input 154 differs depending upon whether the steppre motor 66 is to rotate in a clockwise or a counter-clockwise direction. The character of the pulses is controlled by signals supplied to the direction input 152 of the stepper motor control 106 by the shaft angle position sensing means 160. Thus, when activated by the control electronics 80, the stepper motor control 106 sends electrical pulses of one character to the stepper motor 66 causing it to rotate in one direction. The character of these pulses remains the same until the shaft angle position sensing means 160 signals that the limit of rotation in that direction has been reached. Upon receiving this signal from the shaft angle position sensing means 160, the stepper motor control 106 changes the electrical pulses to that of an opposite character so as to cause the stepper motor 66 to rotate in the opposite direction. This process of sensing the limit of travel in one direction of rotation and therefore causing the stepper motor 66 to reverse its direction of rotation occurs at limits of rotation in both the clockwise and the counter-clockwise direction. Thus, so long as the control electronics 80 supplies the control signal to the start/stop input 104, the stepper motor control 106, responsive to signals supplied to it by the shaft angle position sensing means 160, causes the stepper motor 66 to oscillate radially back and forth between two limits of travel.

Operation of the burnishing apparatus 20 is effected by the electronics control as follows. Depressing the start switch 86 causes the control electronics 80 to send a signal out the tape advance output 94 to the burnishing tape advancing means 46 whereby the burnishing tape 38 is advanced. The control electronics 80 then sends a pulse out the counter reset output 98 to the counter reset input 108 of the counter/comparator 110 resetting the counter which it contains. As a result of resetting the counter contained within the counter/comparator 110, the platen motor 138 is energized causing the platen 24 and the tachometer wheel 146 to rotate synchronously. The control electronics 80 then sends a signal from the oscillation control output 96 to the oscillation start/stop control input 104 of the stepper motor control 106. This causes the stepper motor 66 to be energized and its shaft to oscillate radially between the two limit positions thereby causing the burnishing head 44 and the burnishing tape 38 wrapped partially around it to oscillate laterally. The control electronics 80 then sends a signal from the pneumatic control output 92 causing the compressed air valve 102 to stop the flow of compressed air to the pneumatic cylinder 70.

Stopping the flow of pressurized gases to the pneumatic cylinder 70 causes the arm 60 with the burnishing head 44 attached thereto to rotate downward about the axis of the lead screw 64 bringing abrasive surface 47 of the burnishing tape 38 wrapped around the burnishing head 44 into contact with the rotating oxide-coated surface 12 of the floppy disk 10 located on top of the platen 24. Simultaneously, the lateral translation of the yoke 62 along the lead screw 64 causes the burnishing head 44 with the burnishing tape 38 wrapped partially around it to oscillate the abrasive surface 47 laterally across the oxide-coated surface 12.

The direction of rotation of the platen 24 and consequently the floppy disk 10 is oriented such that a fixed point on the oxide-coated surface 12 first enters into intimate contact with the abrasive surface 47 of the first segment 48. The abrasive surface 47 of the first segment 48 is urged into contact with the oxide-coated surface 12 by the force provided by the combined weights of the burnishing tape 38, the burnishing head 44, the arm 60 and the yoke 62. After having passed the first segment 48 of the burnishing tape 38, the fixed point on the oxide-coated surface 12 contacts the abrasive surface 47 of the second segment 49. The abrasive surface 47 of the second segment 49, which is very long in comparison with the first segment 48, is lightly urged into contact with the oxide-coated surface 12. Contact between the abrasive surface 47 and the rotating oxide-coated surface 12 ceases before the burnishing tape 38 reaches the edge of the floppy disk 10 due to the elevated position of tape guide 42. The effect obtained by rotating the oxide-coated surface 12 so as to first encounter the abrasive surface 47 of the short first segment 48 and then to encounter the abrasive surface 47 of the much longer segment 49 is that the larger particles of the irregularities in the oxide-coated surface 12 are collected principally along the leading edge of the first segment 48 while the second segment 49 collects principally the smaller particles of those irregularities.

When the number of revolutions of the platen 24, as counted by the counter/comparator 110, equals the number of revolutions set by the thumb wheel switch 90, the counter/comparator 110 sends a signal from the equals output 118 to the equals input 100 of the control electronics 80 and, in addition, causes the platen motor 138 to be de-energized. The control electronics 80, in response to the signal received at the equals input 100, simultaneously sends signals from the pneumatic control output 92 to the compressed air valve 102 causing it to open and from the oscillation control output 96 to the start/stop control input 104 of the stepper motor control 106 causing the stepper motor 66 to be turned off. Opening the compressed air valve 102 permits compressed gases to flow to the pneumatic cylinder 70, thereby energizing it and causing it to raise the burnishing head 44. Raising the burnishing head 44 removes the abrasive surface 47 to the burnishing tape 38 from contact with the oxide-coated surface 12 of the floppy disk 10.

The burnishing tape 38 used in the preferred method of operating the burnishing apparatus 20 to burnish approximately eight inch diameter floppy disks 10 having an oxide-coated surface 12 ranging between thirty to fifty microinches in thickness is approximately two inches wide. This tape comprises an approximately 0.001 inch thick polyester base onto which are bonded approximately three micronaluminum oxide particles. This tape is manufactured by Minnesota Mining and Manufacturing Co., which, in addition to manufacturing the tape, provides a service whereby used tape may be cleaned and rejuvenated thereby permitting it to be used over again.

Prior to burnishing each floppy disk 10, the burnishing tape 38 is advanced from the feed reel 40 to the take-up reel 45 in a direction opposite to the direction of travel of the rotating oxide-coated surface 12. In the preferred method of operating the burnishing apparatus 20, the burnishing tape 38 is advanced a distance such that the region of the second segment 49 immediately adjacent to the first segment 48 used to burnish the prior oxide-coated surface 12 becomes the first segment 48 for burnishing the subsequent oxide-coated surface 12. Advancing the burnishing tape 38 this distance assures that the abrasive surface 47 of the first segment 48 is used to burnish only one oxide-coated surface 12 and further that the abrasive surface 47 of the first segment 48 to be used to burnish the subsequent oxide-coated surface 12 has already been used as part of the second segment 49 to burnish prior disks 10. This distance of advancement for the burnishing tape 38 appears to be beneficial to the operation of the burnishing apparatus 20 by permitting to be captured and held along the leading edge of the first segment 48 by the smaller particles already present on that portion of the abrasive surface 47 from burnishing prior oxide-coated surfaces 12.

The cotton swab 56 employed in this preferred method of operating of the burnishing apparatus 20 is approximately one-half inch in diameter and urges the first segment 48 of the burnishing tape 38 into contact with the oxide-coated surface 12 of the floppy disk 10 with a force between 0.88 newtons (90 grams) and 1.08 newtons (110 grams). This force varies cyclically between these two limits depending upon the direction of rotation of the lead screw 64 and, hence, the direction of lateral oscillation of the burnishing tape 38. This cyclic variation in the force, caused by the frictional engagement between the lead screw 64 and the two threaded arms of the yoke 62, appears to be beneficial to the operation of the burnishing apparatus 20.

The preferred method of operating the burnishing apparatus 20 further includes rotating the platen 24 at a substantially uniform rotational speed between approximately 200 to 240 revolutions per minute while urging the abrasive surface 47 of the burnishing tape 38 into contact with the oxide-coated surface 12. While the abrasive surface 47 of the burnishing tape 38 is contacting the rotating floppy disk 10, the tape 38 is also oscillated laterally back and forth across the oxide-coated surface 12 in a plane substantially parallel to the oxide-coated surface 12 between approximately one and three times per revolution of the floppy disk 10. Failure to oscillate the burnishing tape 38 back and forth across the oxide-coated surface 12 causes the abrasive surface 47 to tear the oxide-coated surface 12 from the flexible material 14 of the floppy disk 10. In the preferred method for burnishing an annular region of the floppy disk 10, the abrasive surface 47 of the burnishing tape 38 is disengaged from the oxide-coated surface 12 after burnishing it between approximately fifteen to thirty revolutions.

Although the present invention has been described in terms of the presently preferred embodiment, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

I claim:

1. A method for burnishing an annular region of a coated surface of a disk comprising the steps of:

rotating a disk having a coated surface about an axis substantially normal to said coated surface;

contacting said coated surface with an abrasive surface of a length of burnishing tape, said tape being oriented such that a fixed point on said coated surface of the disk first enters into intimate contact with said abrasive surface of a first segment of the burnishing tape which first segment is urged into contact with said coated surface with a first force and, after having passed said first segment, said fixed point then contacts an abrasive surface of a second segment of the burnishing tape having a common terminal end with said first segment, which second segment is urged toward said coated surface with a lesser force than said first force;

oscillating the burnishing tape back and forth across said coated surface in a path having little or no travel in a direction parallel to the length of said first or said second segments while maintaining intimate contact between both abrasive surface segments and said coated surface; and disengaging said abrasive surface of the burnishing tape from contact with said coated surface of the disk.

2. The method of claim 1 wherein the disk is rotated at a substantially uniform rotational speed.

3. The method of claim 2 wherein the disk is rotated at a substantially uniform rotational speed within the range of approximately 200 to 240 revolutions per minute.

4. The method of claim 1 wherein the length of said second segment of the burnishing tape is greater than one-half the length of a chord across said coated surface immediately adjacent to and parallel to the edge of the burnishing tape closest to the center of the disk.

5. The method of claim 1 wherein said abrasive surface of said first segment of the burnishing tape is urged into intimate contact with said coated surface of the disk by means of a soft, deformable swab in intimate contact with the entire width of the burnishing tape surface opposite said abrasive surface and by means of a resilient backing means in intimate contact with the surface of the disk immediately opposite to said coated surface in intimate contact with said abrasive surface.

6. The method of claim 5 wherein the swab is in the shape of a right circular cylinder and is approximately one-half inch in diameter and the resilient backing means has a hardness within the range of approximately fifty to eighty durometers.

7. The method of claim 6 wherein the width of the burnishing tape is approximately two inches and the first force urging the cotton swab toward the resilient backing means is within the range of approximately 0.88 newtons to 1.08 newtons.

8. The method of claim 1 wherein the burnishing tape is longitudinally stationary and comprises a mylar substrate of approximately 0.001 inch thickness and onto which are bonded aluminum oxide particles of approximately three microns.

9. The method of claim 1 wherein the burnishing tape is oscillated back and forth laterally across said coated surface approximately one to thirty times per revolution of the disk.

10. The method of claim 1 wherein said abrasive surface of the burnishing tape is disengaged from said coated surface of the disk after burnishing said surface for approximately fifteen to thirty revolutions.

11. The method of claim 1 further comprising the step of:

advancing said burnishing tape in a direction opposing the direction of travel of said coated surface of the disk prior to engaging said abrasive surface into contact with said coated surface.

12. The method of claim 11 wherein said burnishing tape is advanced a distance approximately equal to the length of said first segment of said burnishing tape whereby no portion of said segment contacts said coated surface of the disks.

* * * * *